US006874875B1

(12) United States Patent
Anderson et al.

(10) Patent No.: US 6,874,875 B1
(45) Date of Patent: Apr. 5, 2005

(54) INK CARTRIDGE WITH COMPRESSED INK ABSORBING MEMBER THEREIN

(75) Inventors: Stephen A. Anderson, Thompson Station, TN (US); Bruce S. Jones, Franklin, TN (US)

(73) Assignee: Nu-kote International, Inc., Dallas, TX (US)

( * ) Notice: Subject to any disclaimer, the term of this patent is extended or adjusted under 35 U.S.C. 154(b) by 0 days.

(21) Appl. No.: 10/171,059

(22) Filed: Jun. 13, 2002

Related U.S. Application Data

(60) Provisional application No. 60/298,049, filed on Jun. 13, 2001.

(51) Int. Cl.[7] ..... B41J 2/175
(52) U.S. Cl. ..... 347/86; 347/87
(58) Field of Search ..... 347/86, 87, 85, 347/88, 89

(56) References Cited

U.S. PATENT DOCUMENTS 5,786,834 A * 7/1998 Carlotta et al. ..... 347/87
5,903,294 A * 5/1999 Abe et al. ..... 347/87

* cited by examiner

*Primary Examiner*—Stephen D. Meler
*Assistant Examiner*—Ly Tran
(74) *Attorney, Agent, or Firm*—Fay, Sharpe, Fagan, Minnich & McKee, LLP

(57) ABSTRACT

An ink tank cartridge includes a housing having a chamber defined by a set of side walls, a lid, and a first surface. An outlet port is formed in the first surface for communicating ink from the chamber. An ink receiving member for holding the ink is received in the chamber and is held in compression between the side walls. A substantial portion of the surface of the ink receiving member is compressed, preferably more than ⅓of the total surface. The ink receiving member is held uncompressed between the lid and the first surface. A method of assembling an ink cartridge includes providing a housing and a porous ink storage element. The ink storage element is compressed by a set of side walls defining a chamber formed in the housing. The ink storage element is compressed within a range of about 0.5%–50%.

62 Claims, 3 Drawing Sheets

INK CARTRIDGE WITH COMPRESSED INK ABSORBING MEMBER THEREIN

CROSS-REFERENCE TO RELATED APPLICATIONS

This application claims priority from Provisional Application Ser. No. 60/298,049 filed on Jun. 13, 2001.

BACKGROUND OF THE INVENTION

This application relates to an ink jet cartridge or cassette as used in an ink jet printer, and more particularly to an ink cartridge apparatus and method of assembling same for realizing an improved back pressure characteristic in the ink contained within the cartridge. It will be appreciated, however, that the invention may find application in related environments and applications where back pressure of ink contained within a vessel is important to operation of the device.

It is generally known in the art to form a cartridge housing or body from a plastic material. The housing includes one or more cavities or chambers that hold a predetermined supply of ink. For example, a single color of ink may be provided in a single chamber cartridge or multiple chambers may be provided, for example, each holding a different color ink stored therein for selective use in a color printer. It is also generally known to provide a hydrophilic foam ink absorbing member such as a reticulated polyethylene, polyurethane, or melamine foam that fits within the chamber (s). In some arrangements, the ink absorbing member fills the substantial entirety of the chamber, while in other instances, a portion of the ink supply is free ink and the remainder is stored in the ink absorbing member. One or more outlet ports are located in close proximity to the ink absorbing member(s) and communicate with the respective one or more chambers through outlet passages. The outlet passage proceeds through a first or bottom wall of the housing. A supply needle from an associated printer extends through the outlet port and thus conveys ink from the housing to a recording head or print head.

Print quality can be adversely affected by an improper amount of back pressure in the ink contained within the cartridge, particularly in the area adjacent the outlet port and supply needle. Thus, manufacturers of ink cartridges are careful in the design, assembly, shipment, and storage of ink cartridges. One way manufacturers have addressed the issue of back pressure of the ink within the cartridge is through the selection of foam materials having the desired characteristics. Pore size is an important design consideration. Additionally, materials selected from the group including melamine and polyethylene have demonstrated some ability to produce modest back pressure in the ink contained within the cartridge.

Although these attempts have met with success more or less, there is a need in the art for an ink cartridge having an improved foam element therein which provides the desired back pressure characteristic in the ink contained within the cartridge so that print quality is improved.

SUMMARY OF THE INVENTION

The present invention provides an ink cartridge with a porous member held in compression therein.

The ink cartridge includes a housing having a chamber defined by a set of side walls, a lid, and a first surface. An outlet port is formed in the first surface for communicating ink from the chamber. An ink receiving member is received in the chamber and held in compression between the side walls.

The ink receiving member is a hydrophilic foam member, preferably formed of melamine.

The ink receiving member is held in compression between only the side walls and held uncompressed between the lid and the first surface. In that way, a majority of the outer surface of the ink receiving member is compressed. For a rectangular member at least ⅓but preferably ⅔of the surface (four sides out of six) is compressed.

Overall, the ink receiving member has a first dimension before insertion into the chamber and a second dimension, smaller than the first dimension within a range of about 0.5% to 50% but preferably 20% after insertion into the chamber.

According to a method of assembly, a porous ink storage element is first compressed in selected directions and then inserted into the chamber of the housing. The ink storage element is held compressed in the chamber using side walls defining the chamber.

The step of compressing the ink storage element includes compressing the element from side to side but not between the lid and bottom wall of the cartridge.

A primary advantage of the invention resides in the improved print quality that results.

Another advantage of the invention relates to the ability of the cartridge to maintain a more constant back pressure in the ink contained within the cartridge owing to the increased capillary action caused by the compression of the foam element.

Still another advantage is an improved overall back pressure characteristic of the cartridge as the ink is consumed therefrom.

Still other advantages and benefits of the invention will become apparent to those skilled in the art upon reading and understanding the following detailed description.

BRIEF DESCRIPTION OF THE DRAWING

The invention may take form in certain components, structures, and steps, the preferred embodiments of which will be illustrated in the accompanying drawings.

DETAILED DESCRIPTION OF THE INVENTION

Figure 2:
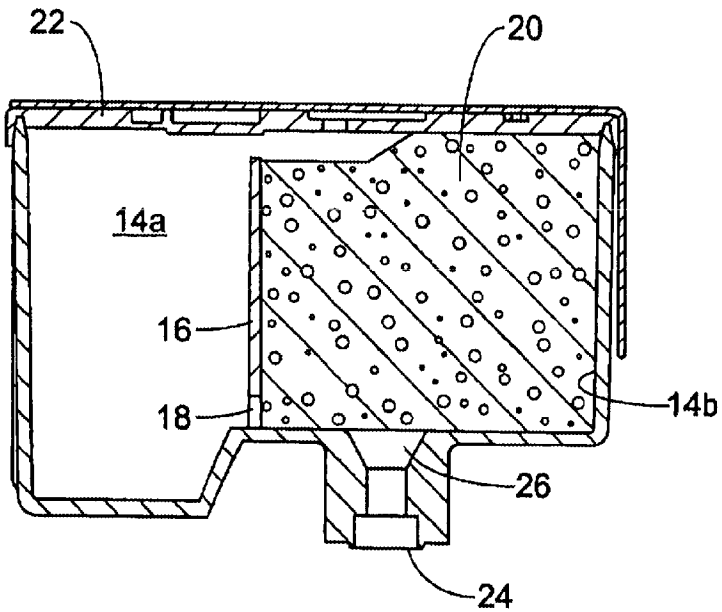
FIG. 2 is a cross-sectional view of an assembled cartridge.
Figure 1:
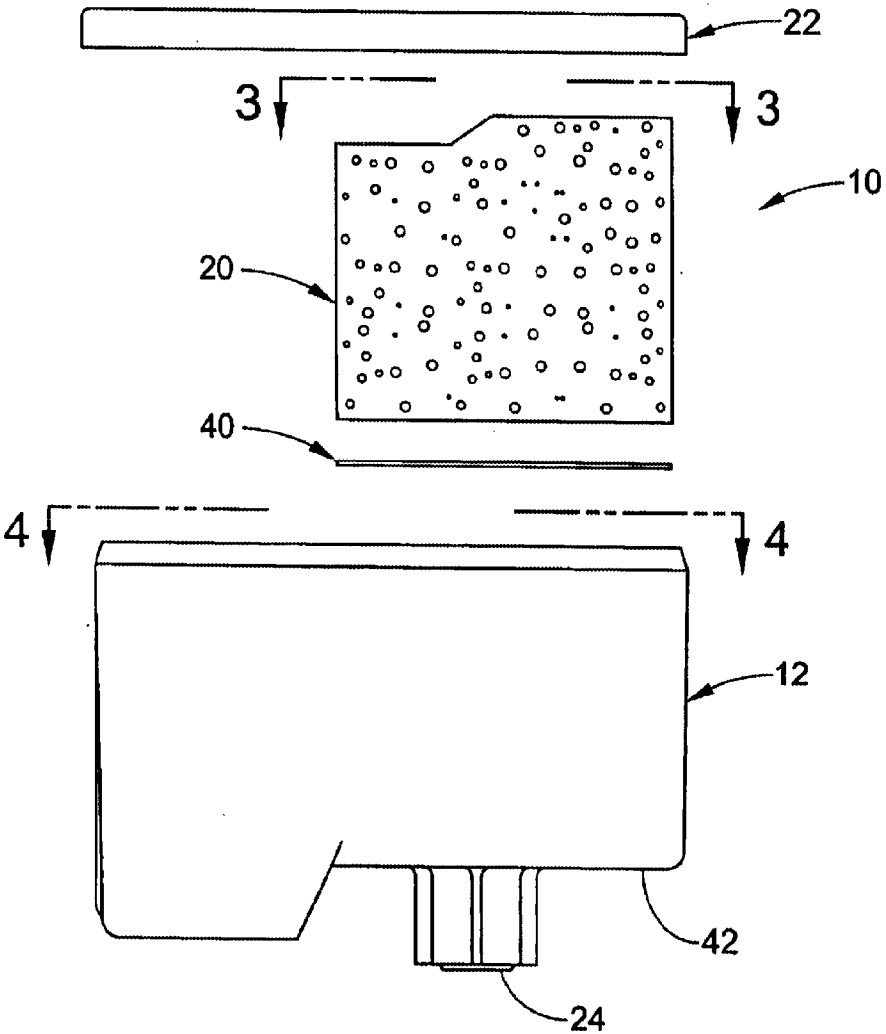
FIG. 1 is an exploded view of an ink jet cartridge.

As illustrated in FIGS. 1 and 2, an ink jet cassette or cartridge 10 includes a housing 12 having an internal chamber or cavity 14 (FIG. 2). As shown here, the housing interior is divided into two cylindrical chambers 14*a*, 14*b* by a dividing wall 16. As illustrated, the directrix of the cylindrical form/shape defining the chambers is substantially rectangular. It will be appreciated, however, that the housing may have one chamber, or multiple chambers. For example, the cartridge may be partially free ink/partially foam design, or the cartridge may be a single color vs. multiple-color cartridge. The invention should not, however, be limited to a single or multi-chamber arrangement. In the partial free ink/partial foam design, a passageway 18 is provided in a base portion of the dividing wall to allow ink to migrate from the free ink side to an ink absorbing member 20. The ink absorbing member is typically a rectangular cylindrical block of porous material or foam such as a reticulated polymer foam or melamine foam, or other conventional hydrophilic ink absorbing member used to store ink within the pores thereof. As shown in FIG. 2, with the partial free ink/partial foam design, the ink absorbing member 20 substantially fills the entire chamber 14*b* on the foam side of the cartridge. In other designs that do not employ free ink, the ink absorbing member fills substantially the entire cavity or portions of a chamber. Again, the invention should not be so limited to any one of these designs.

A lid or cover 22 is received over a first or upper end of the housing and is typically sealingly secured in place. For example, the cover may be ultrasonically welded along a peripheral portion to the cartridge housing to seal the components together. An ink outlet port 24 communicates via an outlet passage 26 with the chamber of the cartridge. In this manner, ink flows from the ink chamber through the outlet passage and ultimately reaches the outlet port 24. The outlet port receives an elastomeric grommet member 28 that is selectively pierced by a needle from an associated printer (not shown). To establish communication through the outlet port with the outlet passage 26 in a manner generally well known in the art.

In order to establish a desired back pressure in the ink contained in the ink cartridge and maintain a more constant back pressure as the ink is consumed, the ink absorbing member 20 is compressed in selected directions. More particularly, the ink absorbing member is compressed between the side walls of the cartridge to a selected degree. The ink absorbing member, however, is held in an uncompressed condition between the cartridge lid and the bottom wall. In that way, a substantial portion of the outer surface of the ink absorbing member is compressed. For the cube-shaped member of the preferred embodiment ⅘of the outer surface (four sides out of six) are compressed. This approach provides a major advantage with regard to improved back-pressure characteristics over foam elements compressed only top to bottom resulting in only ⅔of the outer surface of the element being compressed.

Figure 3:
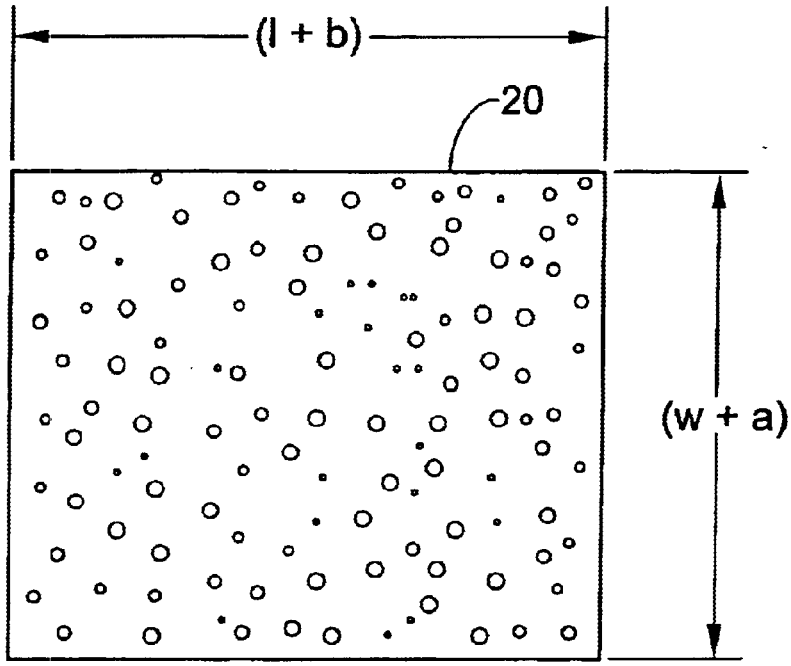
FIG. 3 is a top plan view of the ink absorbing member taken along line 3—3 in FIG. 1.
Figure 4:
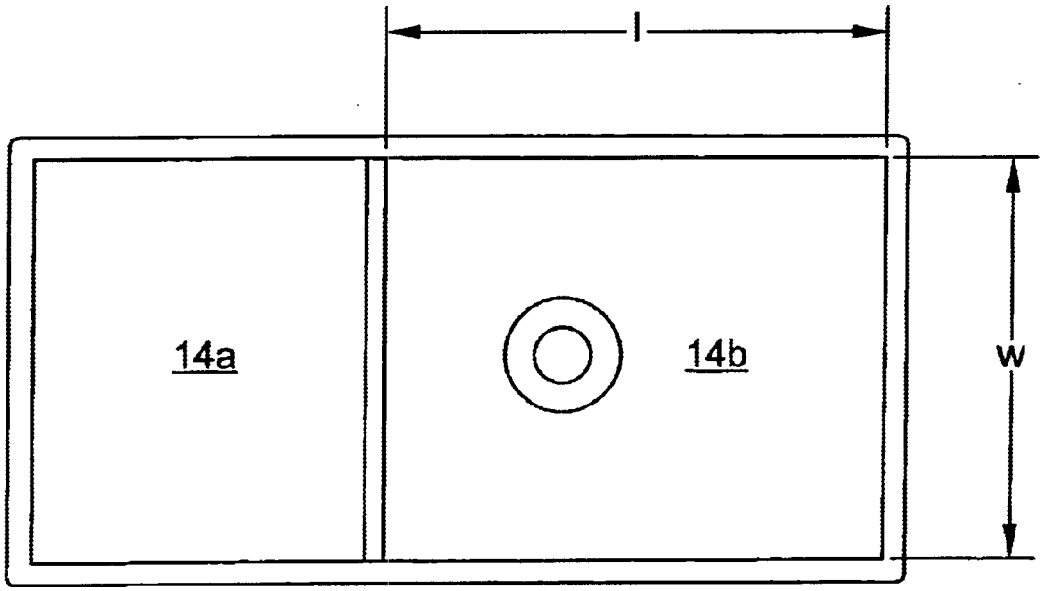
FIG. 4 is a top plan view of the ink cartridge chamber with the foam removed taken along line 4—4 in FIG. 1; and, FIG. 5 is an exploded view, partially cut away, illustrating the assembly of the components.

More particularly, with reference now to FIGS. 3 and 4, the relative dimensions between the ink cartridge chamber 14*b* and the ink absorbing member 20 will be described. As illustrated, the foam side chamber 14*b* of the cartridge 10 has a width w, a length l, and a height h (FIG. 2). The ink absorbing member 20, however, is formed to have a size slightly larger than the extent of the chamber 14*b*. More particularly, as illustrated, the ink absorbing member 20 has a width (w+a), a length (l+b) and a height h (FIG. 1). Preferably, the difference in size between the ink absorbing member 20 and the chamber 14*b* results in a compression within a range of about 0.5%–50%, but preferably about 20% in a plane transverse to an axis extending between the outlet port 26 and the lid 22. To that end, preferably, a=0.20 w and b=0.201. It is to be appreciated that there is preferably no compression in the ink absorbing member 20 in a longitudinal direction between the lid 22 and the outlet port 26. To that end, the ink absorbing member has a height h corresponding substantially to the internal height of the second chamber 14*b*.

Figure 5:
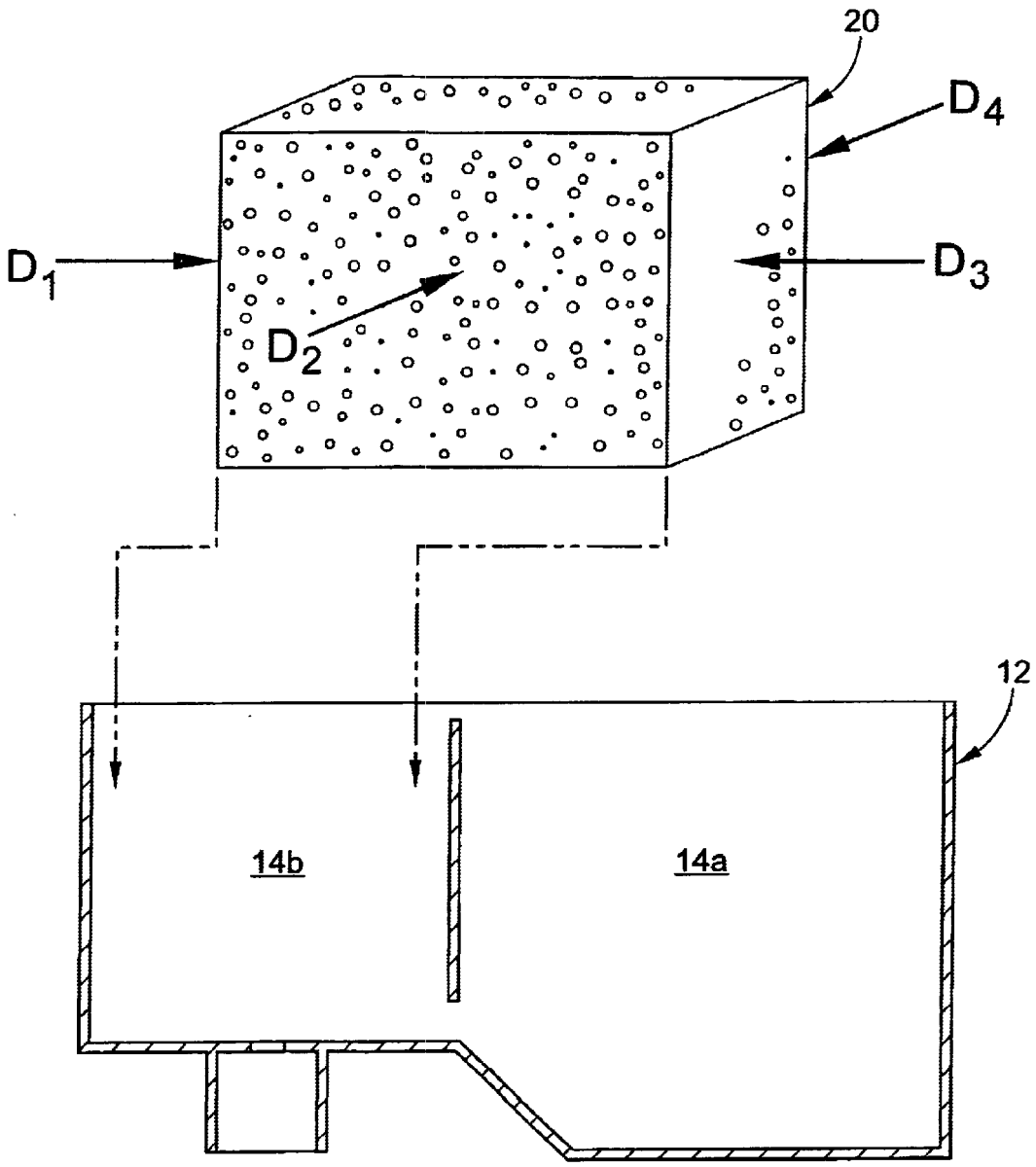

With reference next to FIG. 5, the method of assembling an ink cartridge in accordance with the present invention will be described. As shown there, a housing 12 is provided having a chamber 14*b* defined by a set of side walls 30, 32, 34, 36, a lid 22 and a first surface 42 (FIG. 1). A porous ink storage element 20 is provided and is compressed in selected directions $D_1$–$D_4$. The compressed ink storage element is inserted into the chamber 14*b* and is held in place using the set of side walls 30–36. Lastly, the chamber 14*b* is covered with said lid member 22 (FIG. 1). The housing is provided with a chamber 14*b* having a height h, a width w, and a length l. As noted above, the ink storage element is slightly larger than the volume of the chamber 14*b* so that it is slightly compressed when placed therein. More particularly, the ink storage element 20 has a height h, a width (w+a), and a length (l+b), where $0.005\ w<a<0.5\ w$ and $0.0051<b<0.51$.

After the ink storage element is secured in place, the lid 22 is attached to the housing using ultrasonic welding techniques or the like. Thereafter, ink is impregnated within the ink storage element using suitable vacuum or pressure filling techniques well known in the art. The ink storage element 20 held compressed on its sides but not compressed top to bottom obtains the desired back pressure characteristics in the ink contained within the cartridge and maintains a more constant back pressure as the ink is consumed therefrom.

It is to be appreciated that although a foam element having a generally rectangular cylindrical cross section shape is illustrated, other foam sizes, shapes or configurations are also possible such as, for example, circular cylindrical configurations, shapes or combinations of cube and/or cylinders. In the preferred embodiment, a substantial portion of the outer surface of the ink absorbing member, preferably grater than ⅓of the total surface, is held compressed, regardless of the shape or configuration of the foam element.

The application has been described with reference to the preferred embodiments. Obviously, alterations and modifications will occur to others upon a reading and understanding of the specification. It is intended to include all such modifications and alterations insofar as they come within the scope of the appended claims or the equivalents thereof.

Having thus described the invention, we claim:

1. An ink cartridge comprising:

a housing having a chamber defined by a set of side walls, a lid, and a first surface;

an outlet port formed in the first surface for communicating ink from the chamber; and, an ink receiving member for holding the ink, the ink receiving member being received in said chamber and held in compression between said side walls and held uncompressed between said lid and said first surface.

2. The ink cartridge according to claim 1 wherein said ink receiving member is a porous member.

3. The ink cartridge according to claim 2 wherein said ink receiving member is a hydrophilic foam.

4. The ink cartridge according to claim 3 wherein said ink receiving member is formed of melamine.

5. The ink cartridge according to claim 3 wherein said ink receiving member is formed of polyurethane.

6. The ink cartridge according to claim 1 wherein said ink receiving member has a first dimension before insertion into said chamber and a second dimension, smaller than said first dimension, after insertion into said chamber.

7. The ink cartridge according to claim 1 further including:

a divider wall disposed in said chamber; and, an opening in said divider wall for communicating said ink.

8. The ink cartridge according to claim 1 wherein a substantial portion of the outer surface of the ink receiving member is held in said compression.

9. The ink cartridge according to claim 8 wherein at least ⅓ of the outer surface of the ink receiving member is held in said compression.

10. The ink cartridge according to claim 9 wherein 4/6 of the outer surface of the ink receiving member is held in said compression.

11. An ink cartridge comprising:

a housing having a first chamber defined by an elongate cylindrical side wall surface terminating at opposite top and bottom wall surfaces;

an outlet passage communicating with the first chamber and through which ink is selectively dispensed from said cartridge; and, a porous member holding said ink, the porous member being held in said first chamber compressed by said cylindrical side wall surface and uncompressed between said top and bottom wall surfaces.

12. The ink cartridge according to claim 11 wherein said porous member is a hydrophilic foam.

13. The ink cartridge according to claim 12 wherein said porous member is formed of melamine.

14. The ink cartridge according to claim 12 wherein said porous member is formed of polyurethane.

15. The ink cartridge according to claim 11 wherein said porous member has a first dimension before insertion into said first chamber and a second dimension, smaller than said first dimension, after insertion into said first chamber.

16. The ink cartridge according to claim 11 further including:

a second chamber for holding said ink;

a divider wall disposed between said first chamber and said second chamber; and, an opening in said divider wall for communicating said ink between said second chamber and said first chamber.

17. The ink cartridge according to claim 11 wherein the directrix of said cylindrical side wall surface is rectangular.

18. The ink cartridge according to 11 wherein a substantial portion of the outer surface of said porous member is held compressed by said cylindrical side wall surface.

19. The ink cartridge according to claim 18 wherein at least 1/3 of the outer surface of the porous member is held compressed by said cylindrical side wall surface.

20. The ink cartridge according to claim 19 wherein 4/6 of the outer surface of said porous member is held compressed by said cylindrical side wall surface.

21. A method of assembling an ink cartridge comprising:

providing a housing having a chamber with a height h, a first width w, and a first length l defined by a set of side walls, a lid, and a first surface, for receiving ink therein and having an outlet passage in said first surface for communicating said ink from said chamber;

providing a porous ink storage element with said height h, a second width (w+a), and a second length (l+b), compressing said ink storage element in selected directions;

inserting said compressed ink storage element into said chamber;

holding said compressed ink storage element in said chamber using said set of side walls; and, covering said chamber with said lid.

22. The method according to claim 21 wherein the step of compressing said ink storage element includes compressing said ink storage element to said first width w and to said first length l.

23. The method according to claim 21 wherein the step of compressing includes compressing said ink storage element in directions substantially orthogonal to an axis between said lid and said first surface.

24. The method according to claim 21 wherein the step of compressing includes compressing said ink storage element so that a substantial portion of the outer surface of the ink storage element is compressed.

25. The method according to claim 24 wherein the step of compressing includes compressing said ink storage element so that at least 1/3 of the outer surface of the ink storage element is compressed.

26. The method according to claim 25 wherein the step of compressing includes compressing said ink storage element so that 4/6 of the outer surface of the ink storage element is compressed.

27. A method of assembling an ink cartridge comprising:

providing a housing having a chamber defined by a set of side walls, a lid, and a first surface, for receiving ink therein and having an outlet passage in said first surface for communicating said ink from said chamber;

providing a porous ink storage element;

compressing said ink storage element in selected directions;

inserting said compressed ink storage element into said chamber;

holding said compressed ink storage element in said chamber using said set of side walls; and, covering said chamber with said lid by sealing said lid to said housing without compressing said ink storage element.

28. The method according to claim 27 wherein the step of compressing includes compressing said ink storage element in directions substantially orthogonal to an axis between said lid and said first surface.

29. The method according to claim 27 wherein the step of compressing includes compressing said ink storage element so that a substantial portion of the outer surface of the ink storage element is compressed.

30. The method according to claim 29 wherein the step of compressing includes compressing said ink storage element so that at least 1/3of the outer surface of the ink storage element is compressed.

31. The method according to claim 30 wherein the step of compressing includes compressing said ink storage element so that 4/6of the outer surface of the ink storage element is compressed.

32. In an ink cartridge including a housing having a chamber defined by a set of side walls, a ceiling, and a floor, an ink storage member for holding ink within the chamber, the ink storage member comprising:

an ink absorbing foam received in said chamber and held in compression between said side walls and uncompressed between said ceiling and said floor.

33. The ink storage member according to claim 32 wherein said ink absorbing foam is a hydrophylic foam.

34. The ink storage member according to claim 33 wherein said ink absorbing foam is melamine.

35. The ink storage member according to claim 32 wherein said ink absorbing foam has a first dimension before insertion into said chamber and a second dimension smaller than said first dimension within a range of about 0.5%–50% after insertion into said chamber.

36. The ink storage member according to claim 32 wherein a substantial portion of the outer surface of said ink absorbing foam is held in said compression between said side walls.

37. The ink storage member according to claim 36 wherein at least 1/3 of the outer surface of said ink absorbing foam is held in said compression between said side walls.

38. The ink storage member according to claim 37 wherein 4/6 of the outer surface of said ink absorbing foam is held in said compression between said side walls.

39. In an ink cartridge including a housing having a chamber defined by an elongate cylindrical side wall surface terminating at opposite top and bottom wall surfaces, a porous member holding ink within said chamber, the porous member comprising:

a foam member held in said chamber compressed by said cylindrical side wall surface and uncompressed between said top and bottom wall surfaces.

40. The porous member according to claim 39 wherein said foam member is melamine.

41. The porous member according to claim 39 wherein said foam member has a first dimension before insertion into said chamber and a second dimension smaller than said first dimension within a range of about 0.5%–50% after insertion into said chamber.

42. The porous member according to claim 39 wherein the directrix of said cylindrical side wall surface is substantially rectangular.

43. The porous member according to claim 39 wherein a substantial portion of said foam member is compressed by said cylindrical side wall surface.

44. The porous member according to claim 43 wherein at least 1/3 of the outer surface of said foam member is held compressed by said cylindrical side wall surface.

45. The porous member according to claim 44 wherein 4/6 of the outer surface of said foam member is held compressed by said cylindrical side wall surface.

46. An ink cartridge comprising:

a housing having a chamber defined by a set of side walls, a lid, and a first surface;

an outlet port formed in the first surface for communicating ink from the chamber; and, an ink receiving member for holding the ink, the ink receiving member being disposed in said chamber and not compressed by said lid and said first surface.

47. The ink cartridge according to claim 46, wherein said ink receiving member is a porous member.

48. The ink cartridge according to claim 47, wherein said ink receiving member is a hydrophilic foam.

49. The ink cartridge according to claim 48, wherein said ink receiving member is formed of melamine.

50. The ink cartridge according to claim 48, wherein said ink receiving member is formed of polyurethane.

51. The ink cartridge according to claim 46, wherein said ink receiving member is held in compression by said side walls.

52. The ink cartridge according to claim 46, wherein said ink receiving member has a first dimension before insertion into said chamber and a second dimension, smaller than said first dimension, after insertion into said chamber.

53. The ink cartridge according to claim 46, further including:

a divider wall disposed in said chamber; and, an opening in said divider wall for communicating said ink.

54. An ink cartridge comprising:

a housing having a first chamber defined by an elongate cylindrical side wall surface terminating at opposite top and bottom wall surfaces;

an outlet passage communicating with the first chamber and through which ink is selectively dispensed from said cartridge; and, a porous member holding said ink, the porous member being disposed in said first chamber uncompressed by said opposite top and bottom wall surfaces.

55. The ink cartridge according to claim 54, wherein said porous member is held in compression by said cylindrical side wall surface.

56. The ink cartridge according to claim 55, further including:

a second chamber for holding said ink;

a divider wall disposed between said first chamber and said second chamber; and, an opening in said divider wall for communicating said ink between said second chamber and said first chamber.

57. In an ink cartridge including a housing having a chamber defined by a set of side walls, a ceiling, and a floor, an ink storage member for holding ink within the chamber, the ink storage member comprising:

an ink absorbing foam received in said chamber and held in said chamber uncompressed by said ceiling and said floor.

58. The ink storage member according to claim 57, wherein said ink absorbing foam is held compressed by said side walls.

59. The ink storage member according to claim 58, wherein said ink absorbing foam has a first dimension before insertion into said chamber and a second dimension smaller than said first dimension within a range of about 0.5%–50% after insertion into said chamber.

60. In an ink cartridge including a housing having a chamber defined by an elongate cylindrical side wall surface terminating at opposite top and bottom wall surfaces, a porous member holding ink within said chamber, the porous member comprising:

a foam member held in said chamber and uncompressed by top and bottom wall surfaces.

61. The porous member according to claim 60, wherein said foam member is held compressed by said cylindrical wall surface.

62. The porous member according to claim 61, wherein said foam member has a first dimension before insertion into said chamber and a second dimension smaller than said first dimension within a range of about 0.5%–50% after insertion into said chamber.

* * * * *